US005794545A

United States Patent [19]

McDaniel et al.

[11] Patent Number: 5,794,545

[45] Date of Patent: Aug. 18, 1998

[54] LINKABLE MODULAR TABLE SYSTEM

[75] Inventors: Randall D. McDaniel, Tuscumbia; Gergory J. White, Decatur, both of Ala.

[73] Assignee: JAMI, Inc., Overland Park, Kans.

[21] Appl. No.: 800,051

[22] Filed: Feb. 14, 1997

[51] Int. Cl.[6] ..... A47B 57/00

[52] U.S. Cl. ..... 108/64; 248/188

[58] Field of Search ..... 108/64, 69, 65; 248/188.1, 188, 188.8

[56] References Cited

U.S. PATENT DOCUMENTS

| | | | |
|---|---|---|---|
| 2,619,394 | 11/1952 | Mahr . | |
| 3,046,595 | 7/1962 | Johansson et al. . | |
| 3,342,147 | 9/1967 | Shettles | 108/64 |
| 3,915,100 | 10/1975 | Sullivan | 108/64 |
| 4,665,836 | 5/1987 | Burr | 108/64 |
| 5,182,996 | 2/1993 | Gutgsell | 108/64 |
| 5,339,747 | 8/1994 | Epps | 108/64 |
| 5,341,749 | 8/1994 | Noakes | 108/64 |
| 5,435,254 | 7/1995 | Amey et al. | 108/64 |
| 5,438,937 | 8/1995 | Ball et al. | 108/64 |
| 5,528,996 | 6/1996 | Edwards et al. | 108/64 |
| 5,560,302 | 10/1996 | Diffrient et al. | 108/64 |

*Primary Examiner*—Jose V. Chen

*Attorney, Agent, or Firm*—Litman, McMahon & Brown, LLC

[57] ABSTRACT

A modular table top system includes a variety of differently shaped modular table tops, including rectangular, triangular, curved, semi-circular, etc., which can be selectively linked to form customized table or desk shapes. Each modular table top accommodates leg brackets along linkable edges thereof in alternative positions. In a first position, each leg bracket is positioned completely under the table top proximate the linkable edges thereof, and, in a second position, each leg bracket is rotated 180 degrees to a position straddling two adjacent linked table tops. With leg brackets straddling adjacent table tops, the number of legs required to support a linked structure is reduced, allowing greater freedom of chair placement, and reducing overall cost.

12 Claims, 16 Drawing Sheets

LINKABLE MODULAR TABLE SYSTEM

FIELD OF THE INVENTION

The present invention relates to a linkable modular table system. More particularly, the table system includes table tops of a variety of shapes which can be selectively linked to form a variety of custom desk and conference arrangements.

BACKGROUND OF THE INVENTION

Manufacturers of furniture have long faced the dual problem of providing efficiency in manufacture by designing modular components which can be readily mass produced while simultaneously meeting customer demands for customized furniture to meet specialized situations.

Early attempts to address the problem include the addition or removal of table leafs to selectively, respectively, lengthen or shorten tables. Other variations include that shown in U.S. Pat. No. 3,342,147 to Shettles and entitled MODULAR TABLE. In the '147 patent, a plurality of equilateral triangle shaped table tops are each positioned atop a respective fixed pedestal. Each triangular top includes locking elements positioned along each side such that the tops can be selectively interlocked to form a number of different table shapes.

Another attempt to create modular tables which can be combined to form customized shapes is taught in U.S. Pat. No. 4,665,836 to Burr. In the '836 patent, table tops of different shapes, e.g. rectangular, corner and semi-circular, each include a permanent pedestal base. The table tops can be selectively interlocked to form a variety of custom shapes. The linking elements include slotted brackets which can be selectively extended and retracted with the slots accommodating thumb screws beneath one or two of the table tops.

In these prior art systems, each modular table top shape includes one or more fixed pedestals which are used for support. This limits the degree of customization which can be devised since the pedestal positions cannot be varied. Anther drawback is the need for separate connecting hardware for the pedestal brackets and for the interlocking elements.

It is clear, then, that a need exists for a modular table system which can be customized to any of a variety of shapes by selectively linking modular components. Such a table system should include supports which can be positioned entirely under one of the modular table tops, or which can straddle a linked pair of adjacent table tops.

SUMMARY OF THE INVENTION

The present invention is drawn to a linkable modular table top system. The table top system includes a variety of differently shaped modular table tops, including rectangular, triangular, curved, semi-circular, etc., which can be selectively linked to form customized conference table or desk shapes. Modular leg brackets are provided, which brackets can be attached to any of the modular table tops by providing each modular table top with a plurality of threaded anchors extending into the bottom side of the table top in positions proximate linkable edges thereof. For example, four such threaded anchors are positioned to form a square shaped pattern proximate each linkable edge, with each square being approximately centered along and being perpendicular to the respective linkable edge. The square shaped pattern of the threaded anchors is sized to match corresponding through slots in the leg bracket, with the two anchors of the square shape which are closest to the linkable edge being spaced inward from that edge approximately one-half the width of the bracket. This allows the leg bracket to be installed entirely beneath one modular table top, or, alternatively, to be turned 180 degrees to straddle, and link, a pair of linked modular table tops. Threaded thumb screws are provided for each threaded anchor to secure the leg brackets thereto. With leg brackets straddling adjacent table tops, the number of legs required to support a linked structure is greatly reduced, allowing greater freedom of chair placement and reducing overall cost. Linking members are also provided which can be used in addition to, or in lieu of, the leg pedestals to link adjacent table tops.

OBJECTS AND ADVANTAGES OF THE INVENTION

The objects and advantages of the present invention include: providing a linkable modular table top system; providing such a system in which multiple table tops of diverse shapes can be linked to form custom table and/or desk arrangements; providing such a system in which supporting legs are attached to each table top via respective leg brackets; providing such a system in which each leg bracket can be attached solely beneath one table top to allow that table top to be used independently, or, alternatively, which can be rotated 180 degrees and attached to straddle and link a pair of modular table tops; providing such a system which allows maximum flexibility and adaptability in custom table design and configuration; providing such a system in which the number of supporting legs can be minimized, thus reducing cost, allowing greater chair placement and minimizing cost; and providing such a linkable modular table top system which is relatively simple, economical to manufacture, yet is versatile, durable and is particularly well suited to its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
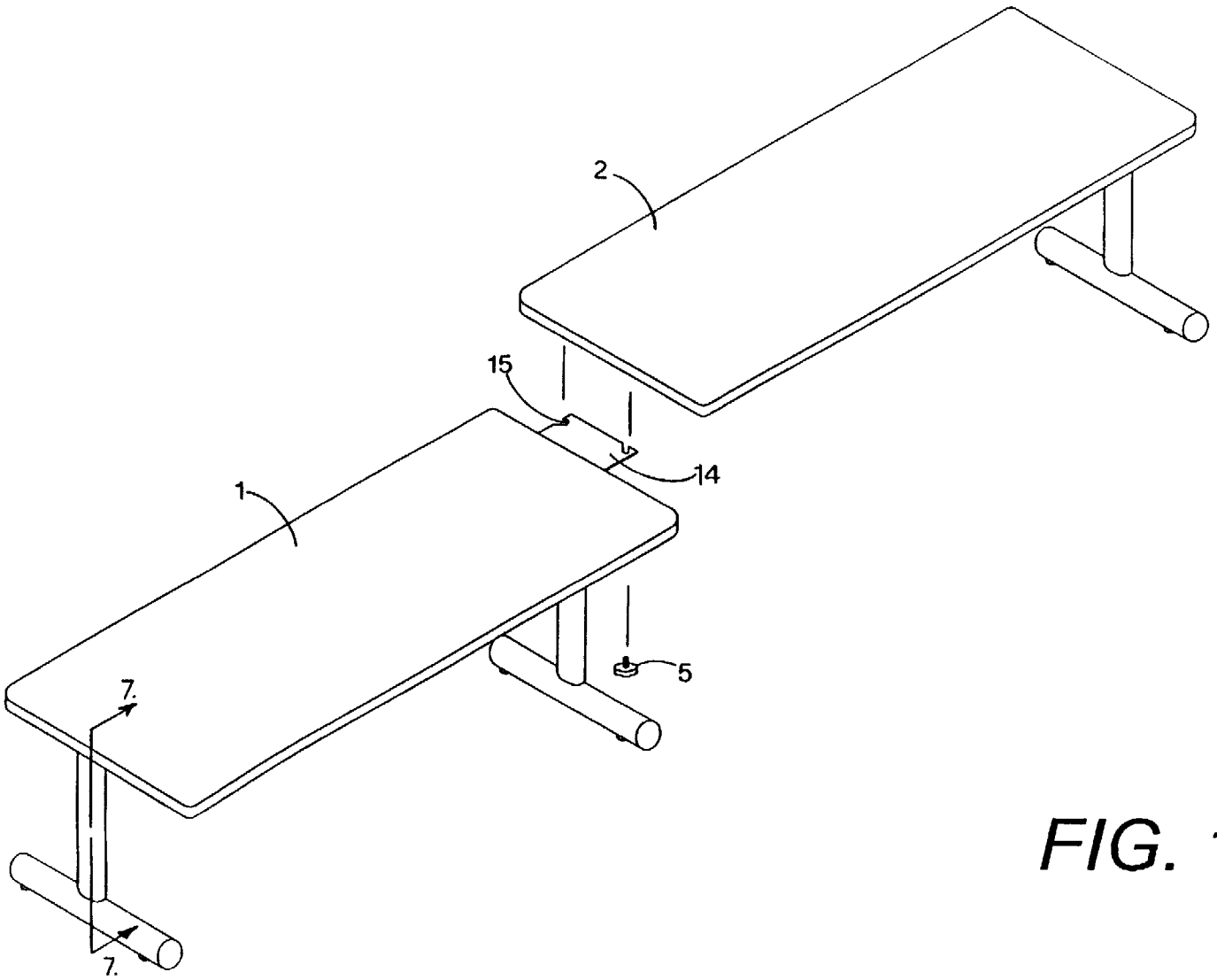
FIG. 1 is a perspective view showing top surfaces of a pair of rectangularly shaped modular table tops being linked via a leg bracket which straddles the adjacent edges of the table tops.
Figure 3:
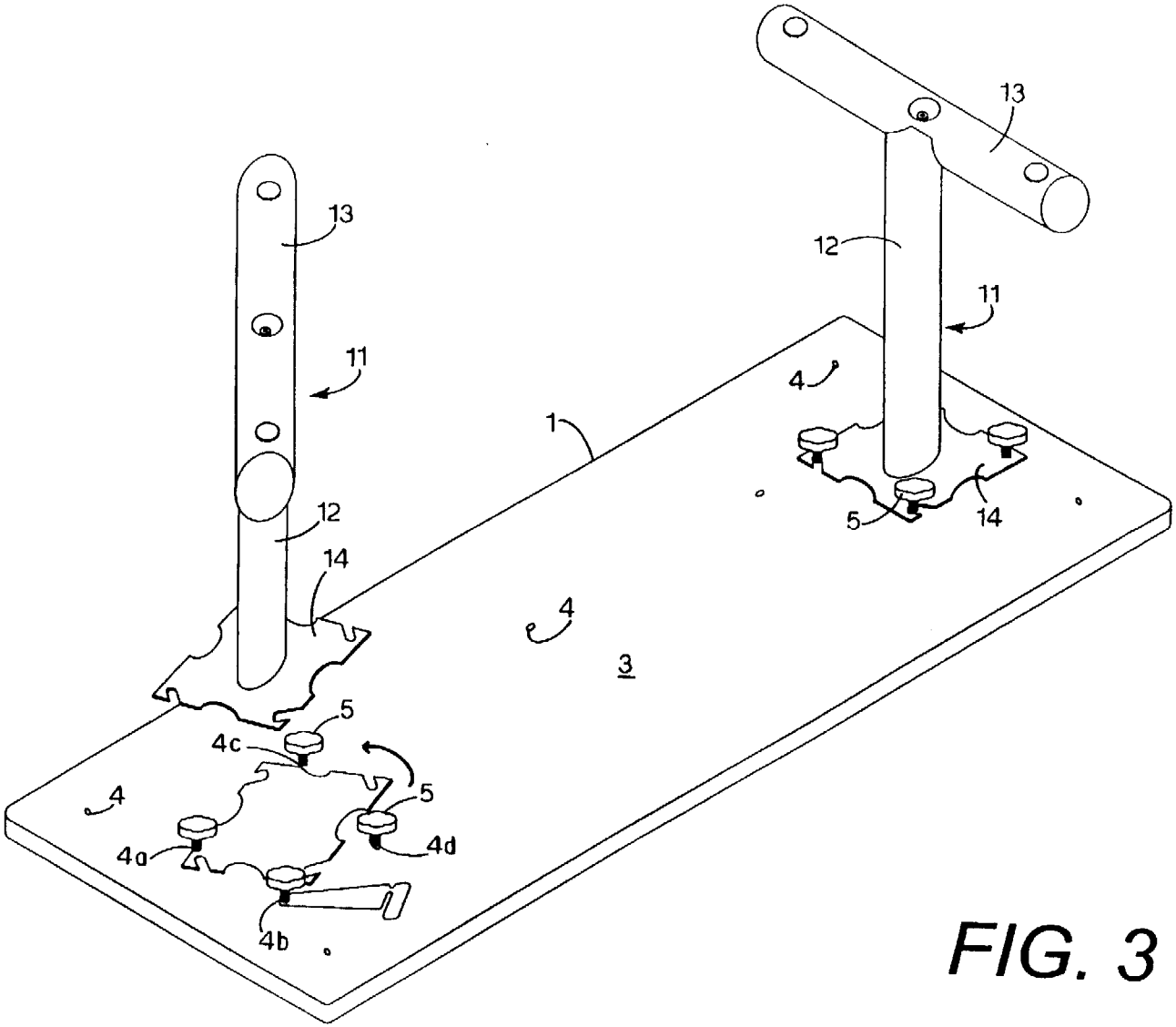
FIG. 3 is a perspective view showing a bottom surface of one of the rectangular modular table tops, showing the various components thereof.
Figure 4:
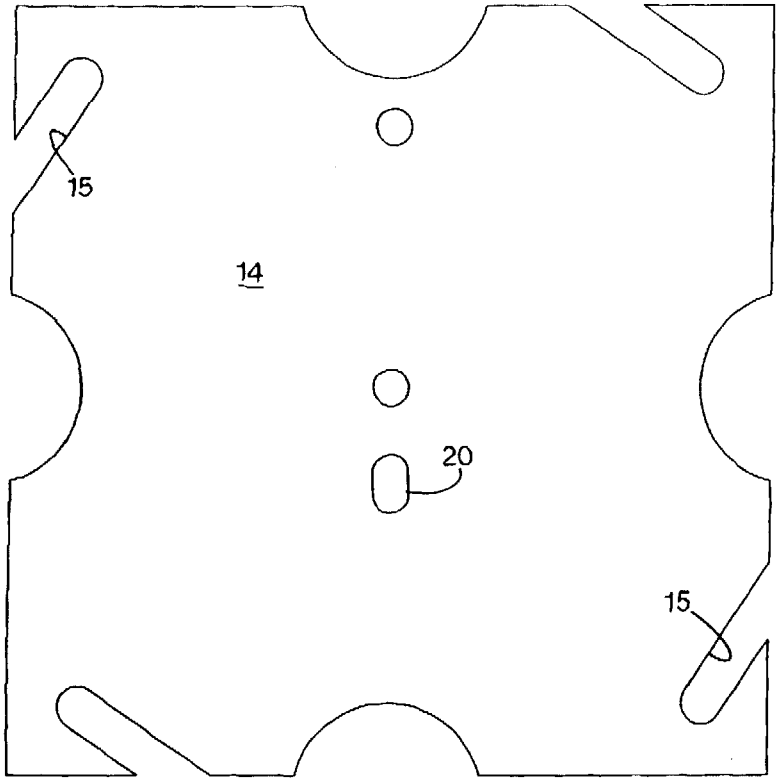
FIG. 4 is a top plan view of a leg bracket for the modular table system.
Figure 5:
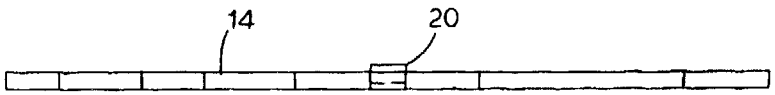
FIG. 5 is a side elevational view of the leg bracket of FIG. 5.

Referring to FIG. 1 of the drawings, a pair of generally rectangular modular table tops 1 and 2 are illustrated proximate each other. Each table top 1 and 2 is of the type illustrated in FIG. 3, where a bottom surface 3 of the table top 1 is illustrated. The bottom surface 3 is provided with a number of threaded anchors 4 positioned therein. Each threaded anchor 4 is sized to accept a threaded thumb screw 5. A pair of legs 11, each of which includes a vertically oriented pedestal 12 and a horizontally oriented foot 13, are removably attached to the bottom surface 3 of the table top 1 via a respective leg bracket 14.

The leg brackets 14 are illustrated in greater detail in FIGS. 4, 5, 7 and 8. Each leg bracket 14 comprises a flat plate generally shaped as a square, with four angled slots 15 positioned in respective sides of the square. A threaded nut 21 (FIG. 7) is welded in the center of the bracket 14. The four slots 15 are positioned to align with respective groups of four of the threaded anchors, numbered as 4*a*–4*d*, which anchor groups are positioned near opposing ends of the table top 1. The two anchors 4*a* and 4*b* which are closest to the respective edge of the table 1 are positioned inward from the edge a distance slightly less than one-half of the width of the leg bracket 14. The leg bracket 14 can thus be positioned entirely on the bottom surface 3 of the table top 1 by placing the slots 15 over respective ones of the anchors 4*a*–4*d* and tightening the thumb screws 5 thereover, as shown in the right side of FIG. 3. The slots 15 are angled at an angle of approximately 55 degrees, which allows the leg bracket 14 to be easily installed and removed from the table tops 1 and 2 by simply loosening the holding thumb screws 5 and rotating the leg brackets 14 to release the slots 15 from engagement with the thumb screws 5, as is illustrated in the left side of FIG. 3. Installation of the leg bracket 14 is accomplished in a reverse fashion. Alternatively, the leg bracket 14 is rotated 180 degrees to a position in which two of the slots 15 are positioned over the anchors 4*a* and 4*b* with those thumb screws 5 being tightened thereover. The other slots 15 can thus be positioned over the anchors 4*a* and 4*b* on the adjacent table top 2, and attached by additional thumb screws 5, with the leg bracket 14 thus straddling the table tops 1 and 2 while linking the tops 1 and 2 together. The pedestal 12 and foot 13 are thus positioned to support both table tops 1 and 2 while the leg bracket 14 straddles and links the table tops 1 and 2 together.

Figure 7:
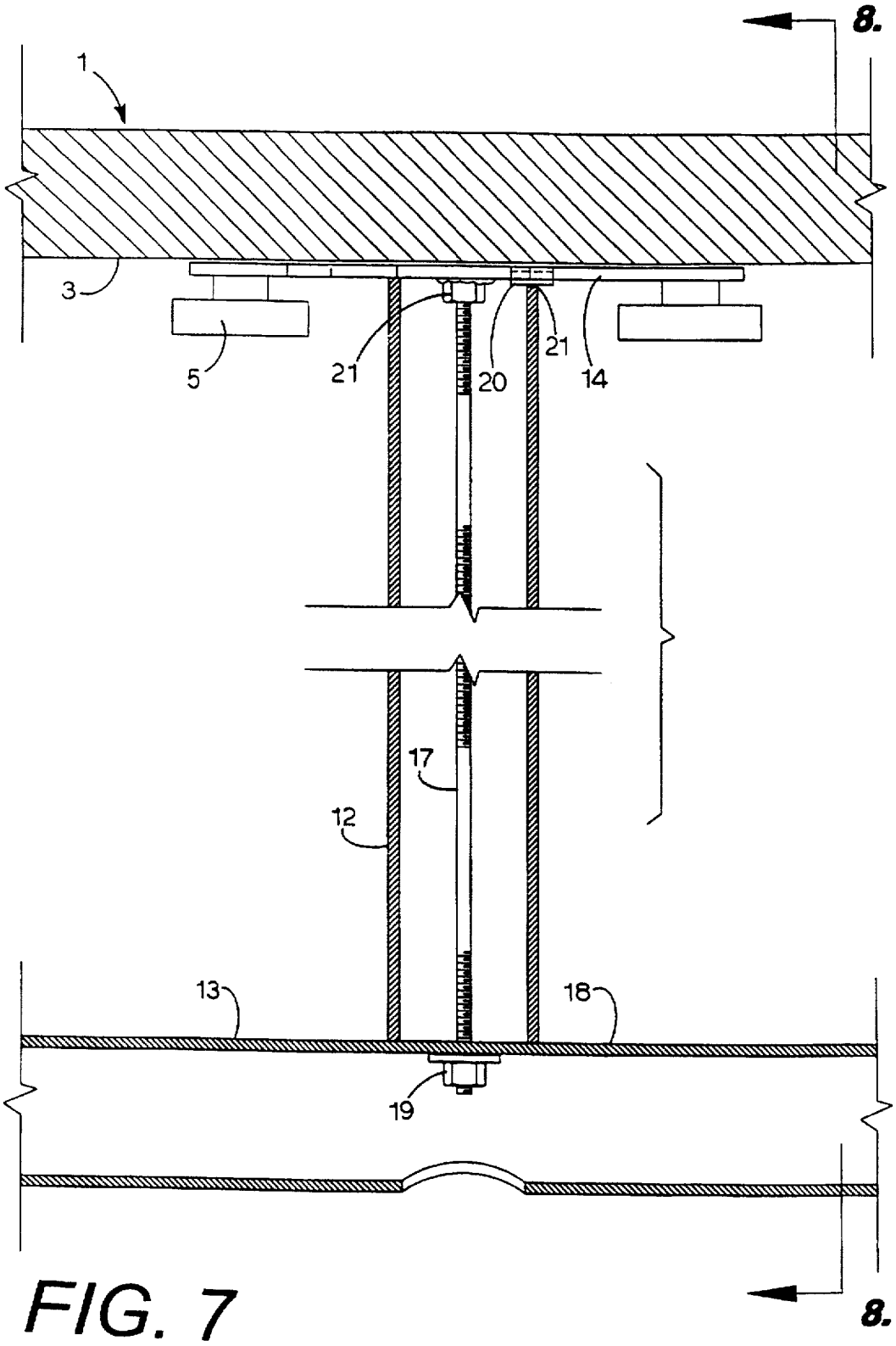
FIG. 7 is a greatly enlarged, fragmentary cross-sectional view of a leg bracket, pedestal and foot attached to a modular table top, taken along line 7—7 of FIGS. 1 and 8.
Figure 8:
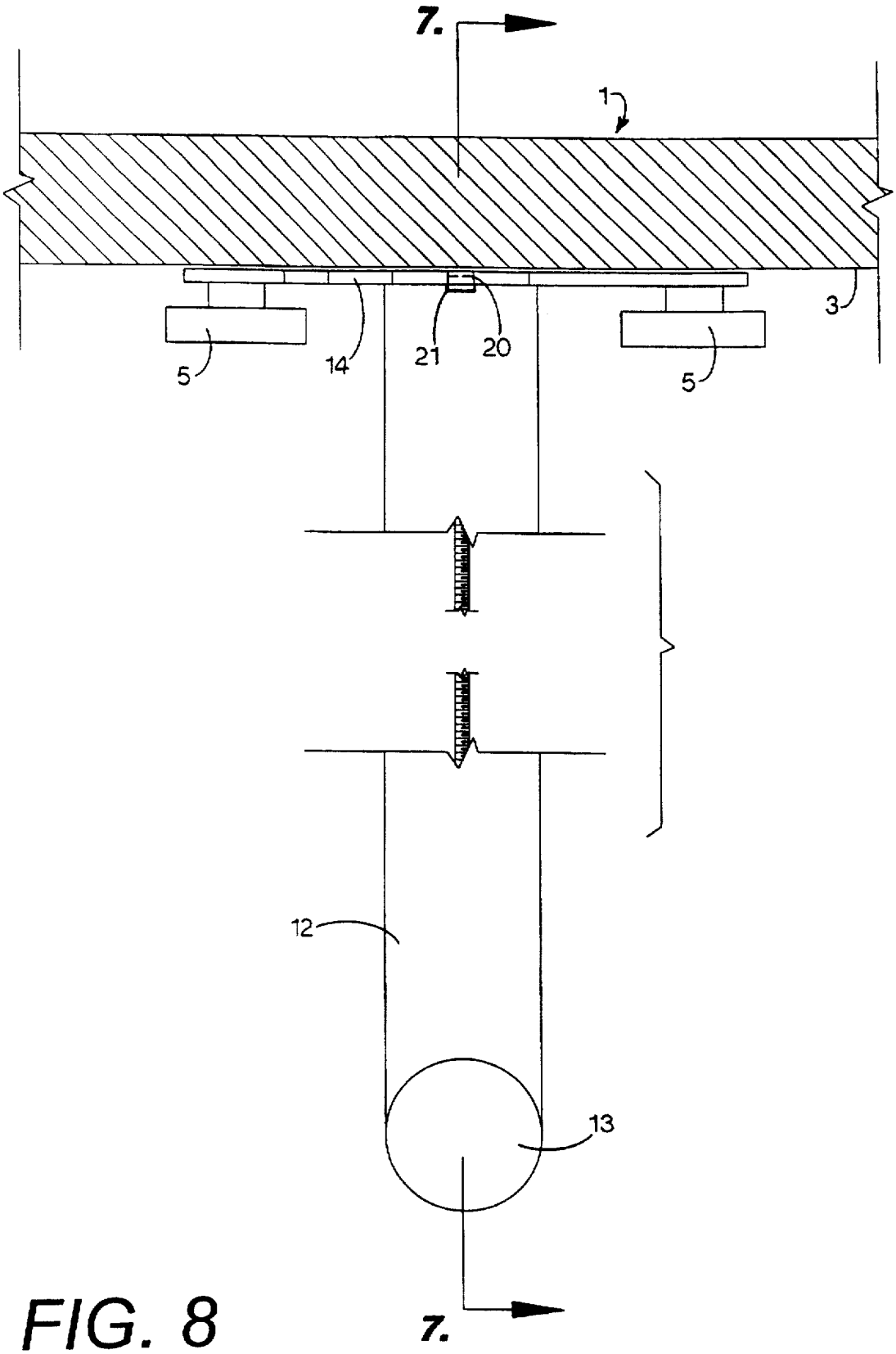
FIG. 8 is an end view of a leg bracket, pedestal and foot attached to a modular table top, with a view taken along line 8—8 of FIG. 7.

FIGS. 7 and 8 illustrate the attachment of the pedestal 12 and the foot 13 to the leg bracket 14. A threaded nut 16 is welded onto the bottom of the leg bracket 14 to receive an upper end of a threaded rod 17 which extends longitudinally through the pedestal 12 and through a top surface 18 of the foot 13. A nut and integral washer 19, inset into the foot 13, is threaded onto a bottom end of the rod 17 to retain the foot 13 onto the pedestal 12. A keyway extrusion 20 protrudes outward from the bottom surface of the leg bracket 14 to mate with a recess 21 in the pedestal 12 to properly align the pedestal 12, and the attached foot 13, with the leg bracket 14.

Figure 2:
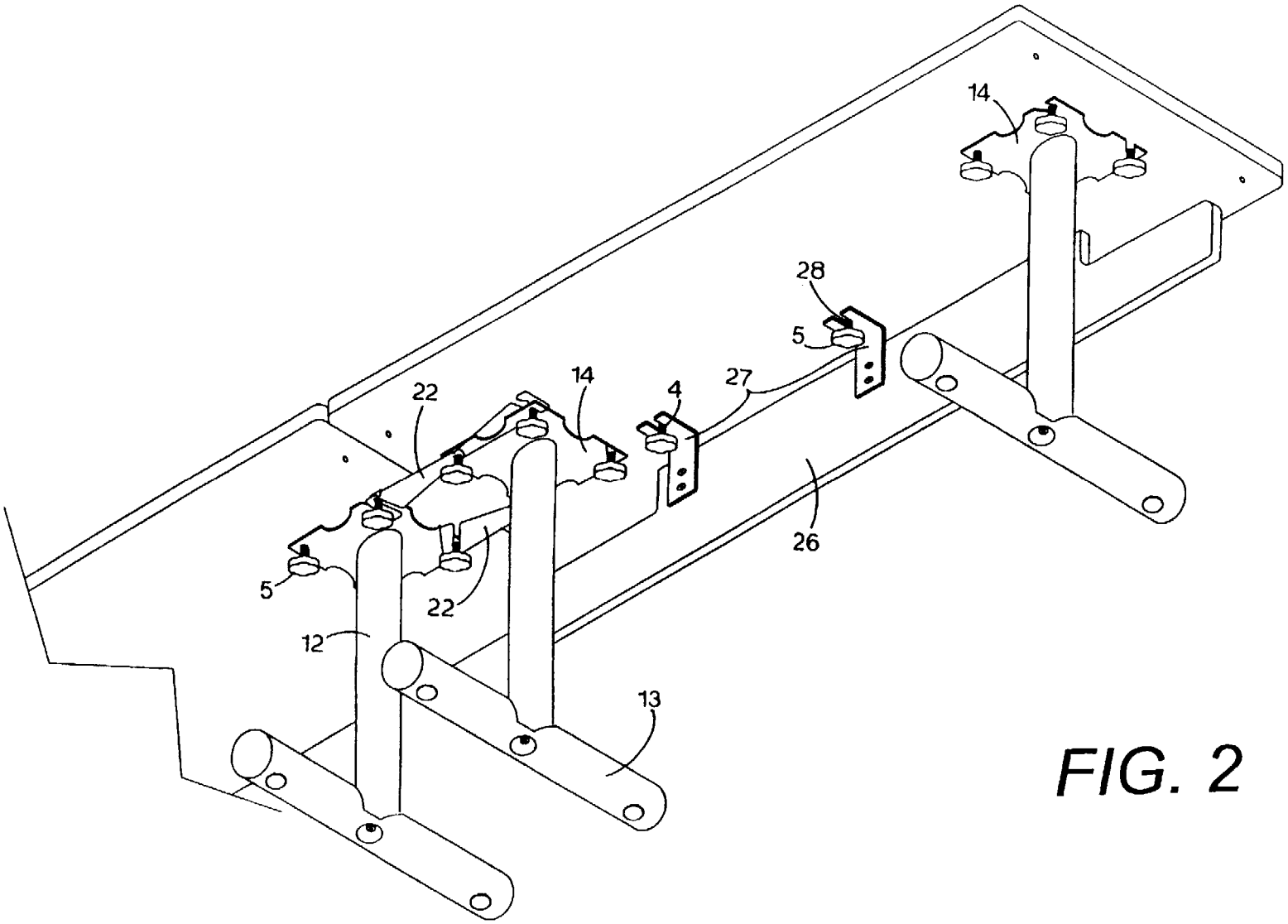
FIG. 2 is a fragmentary, perspective view showing bottom surfaces of the pair of rectangularly shaped table tops, illustrating an alternative linking arrangement with leg brackets on each table top and with linking members linking the table tops.
Figure 6:
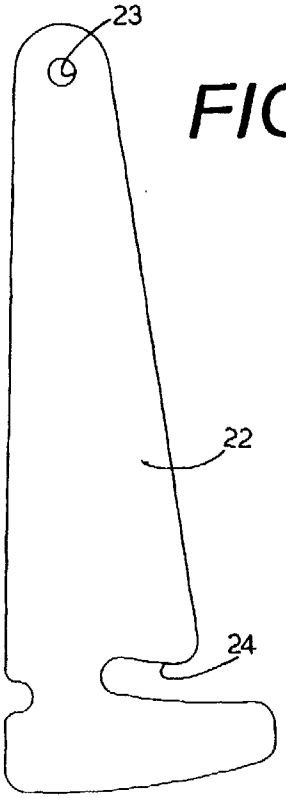
FIG. 6 is a top plan view of a linking arm for the modular table system.

FIG. 2 illustrates an alternative linking arrangement in which a pair of linking members 22, which are illustrated in greater detail in FIG. 6, are used to link the table tops 1 and 2 together. Each linking member 22 is an elongate flat plate with an aperture 23 near a first end and a slot 24 near a second end thereof. During installation of the leg brackets 14 on the table top 1, a pair of the linking members 22 can be initially attached to the table top 1 (FIG. 3) by positioning the apertures 23 over respective anchors 4*a* and 4*b* and tightening the respective thumb screws 5 over the leg bracket 14 to hold the linking members 22 and the leg bracket 14 in place. When the table tops 1 and 2 are to be linked, as shown in FIG. 2, the pair of thumb screws 5 which hold the apertures of the linking members 22 are loosened and the linking members 22 are swiveled 180 degrees such that the slots 24 are engaged with shafts 25 of respective ones of the thumb screws 5 on the adjacent table top 2, which thumb screws 5 can then be tightened to hold the linking members 22 in place to link the table tops 1 and 2. Also shown in FIG. 2 is a modesty panel 26 which is removable attached beneath the table 1 via a pair of angled brackets 27 equipped with slots 28 which match up with additional threaded anchors 4 to accommodate respective thumb screws 5. The modesty panel 26 allows the table 1 to be used as a desk. Washers 29, which are preferably the same depth as the leg brackets 14, can be used to equalize the height of opposing ends of the linking members 22.

Figure 9:
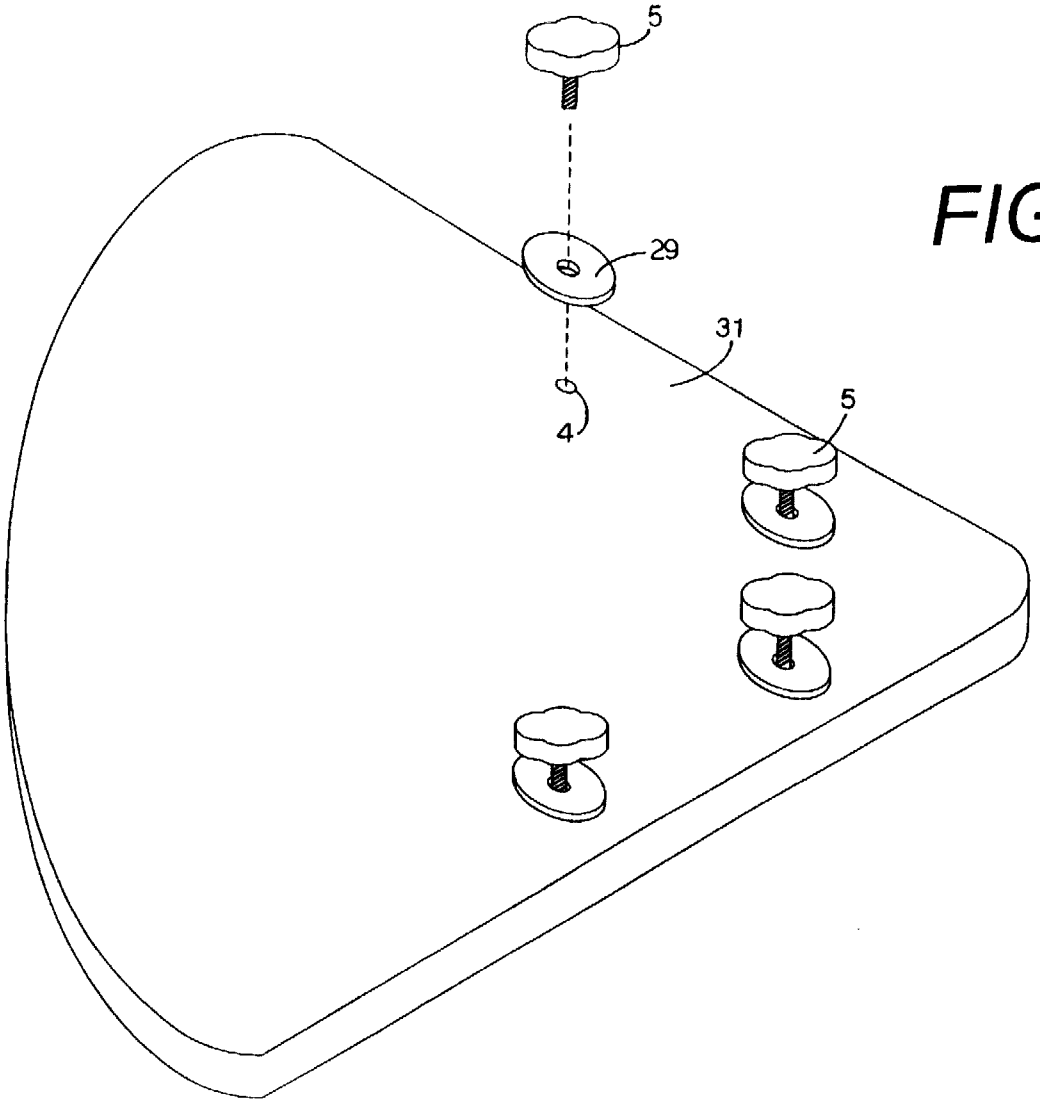
FIG. 9 is a perspective view showing a bottom surface of a triangular shaped modular table top.
Figure 10:
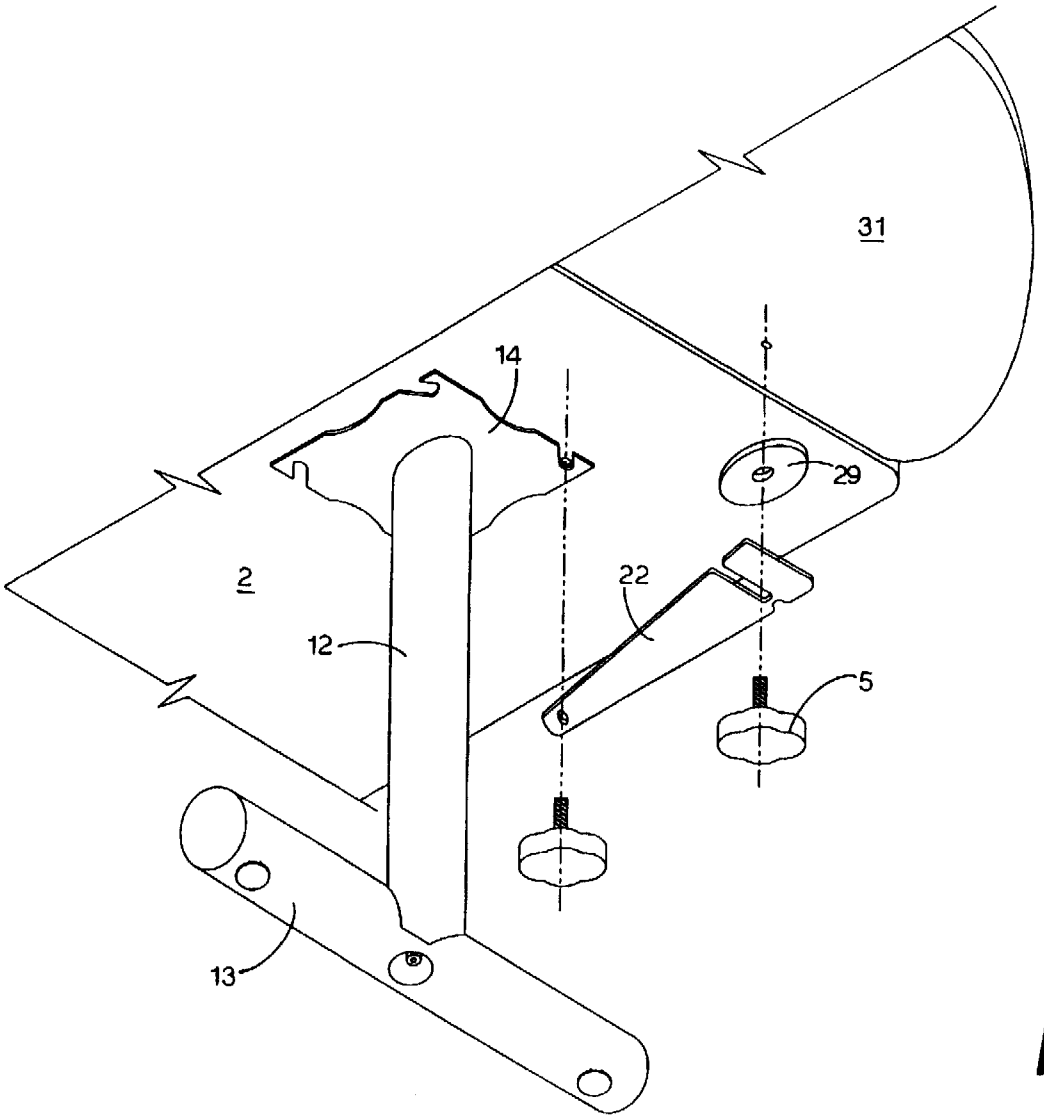
FIG. 10 is an enlarged, fragmentary, perspective view of the bottom side of the triangular shaped modular table top of FIG. 7 being linked to one of the rectangularly shaped modular table tops of FIG. 1.

FIGS. 9–15 illustrate several variations of an arrangement including a triangular shaped modular table top 31, illustrated in detail in FIG. 9, linked between a pair of rectangular table tops 1 and 2 to form a right angled table. Referring to FIG. 9, the triangular shaped table top 31 includes at least two pairs of threaded anchors 4 with each pair being positioned proximate a respective straight edge of the table top 31 and being separated from each other and from the edge the same distances as the anchors **4*a* and 4*b* in FIGS. 1-3. The table top 31 can, optionally, include two additional pairs of threaded anchors 4 (FIG. 11) arranged in a square and spaced equidistantly from the straight edges of the table top 31 to accommodate a leg bracket 14 such that the triangular table top 31 includes its own leg support. Note that some of the pedestals 12 in FIGS. 11–15** have been broken away to reveal the linking arrangements.

Figure 11:
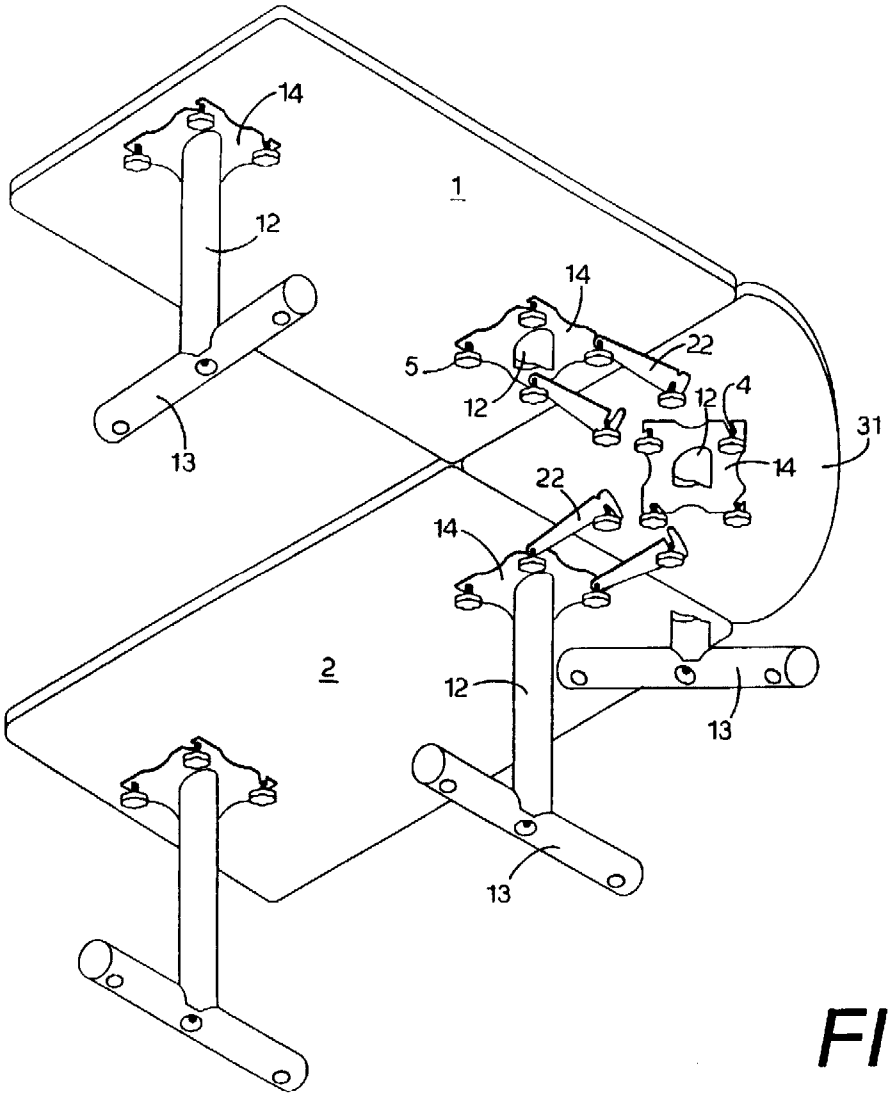
FIG. 11 is a perspective view of the bottom side of the triangular shaped modular table top being linked to a pair of the rectangularly shaped table tops via ganging members to form a composite L shaped table, with the triangular shaped table top also including a centered leg bracket.
Figure 12:
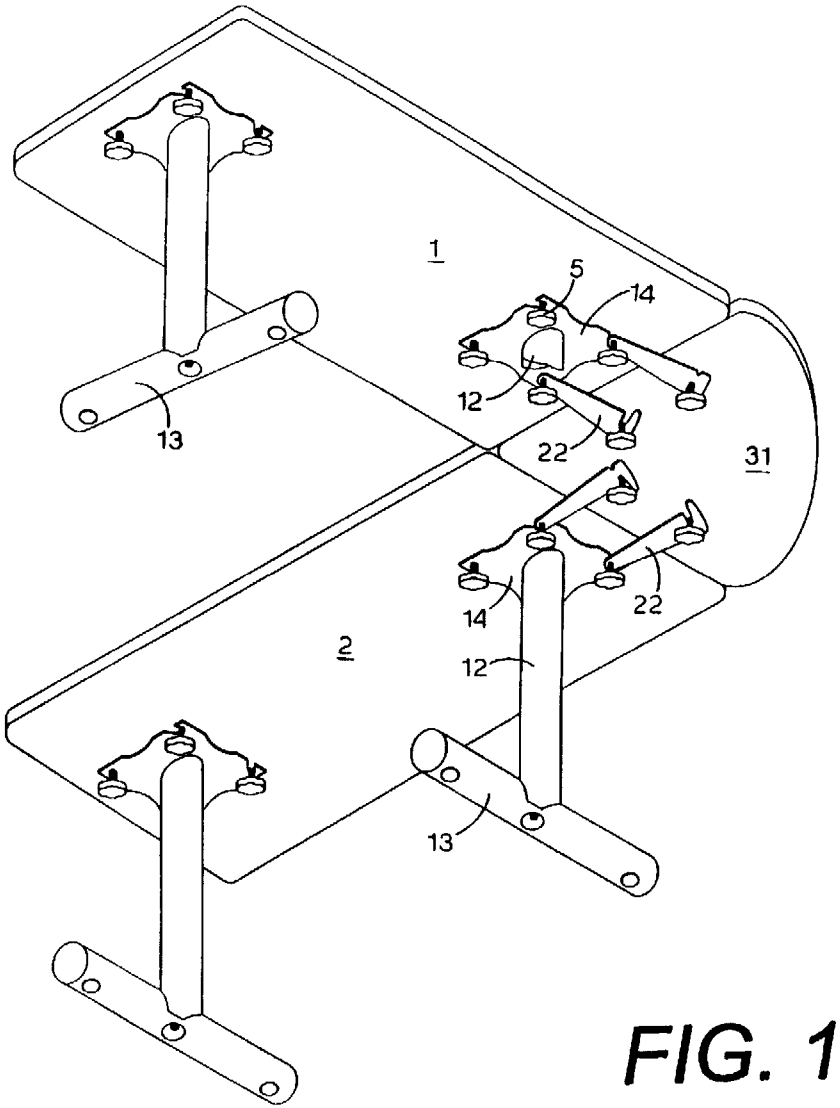
FIG. 12 is a perspective view of the bottom side of the triangular shaped modular table top being linked to a pair of the rectangularly shaped table tops via ganging members to form a composite L shaped table, but with the centered leg bracket removed from the triangular shaped table top.
Figure 13:
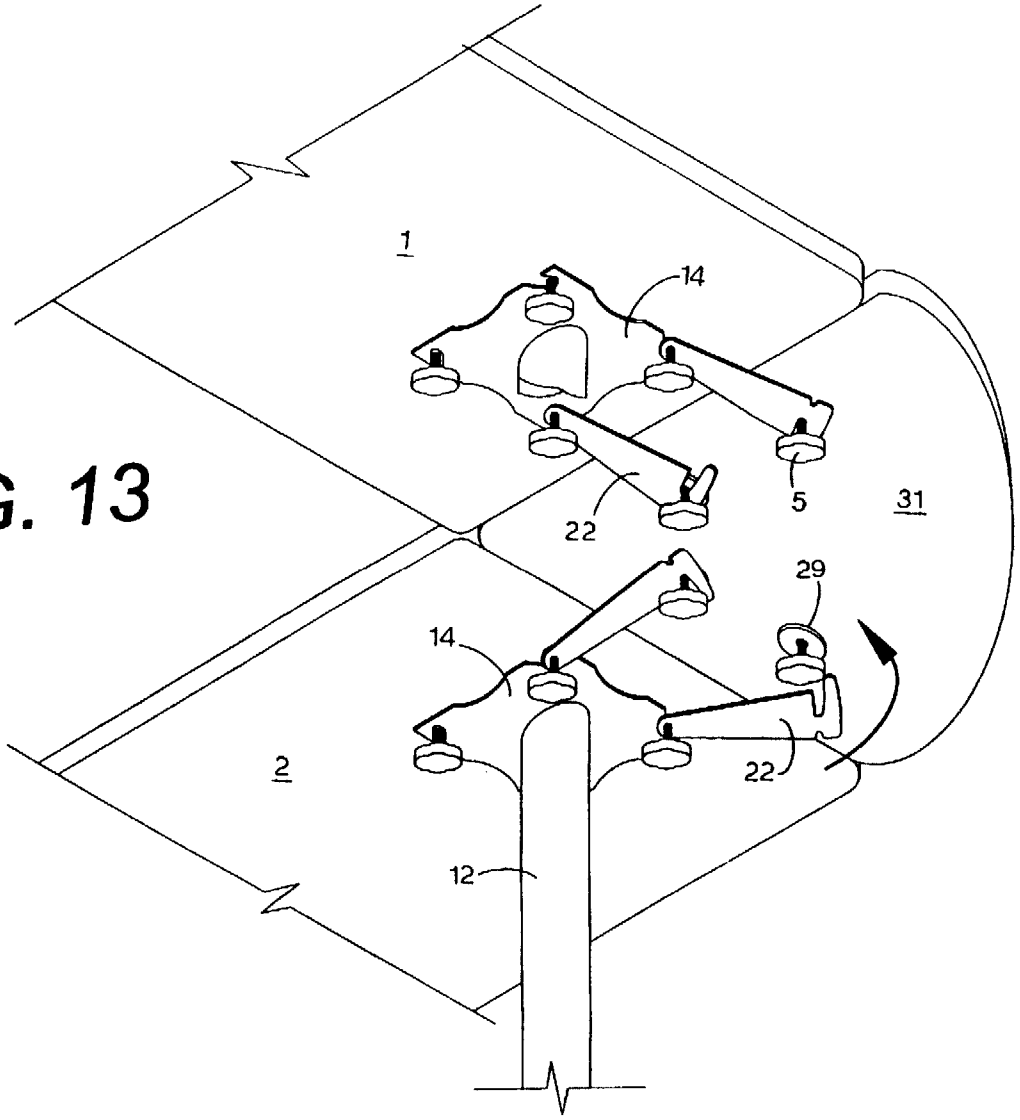
FIG. 13 is an enlarged, fragmentary, perspective view of the bottom side of the triangular shaped modular table top being linked to a pair of the rectangularly shaped table tops via ganging members as in FIG. 10.

Referring to FIG. 11, the triangular shaped table top 31, with its own leg bracket 14, is linked to the rectangular table tops 1 and 2 via respective linking members 22 used in the same fashion as described earlier with respect to FIG. 2. FIGS. 12 and 13 illustrate a similar linking arrangement using linking members 22, but with the triangular shaped table top having no separate leg bracket 14.

Figure 14:
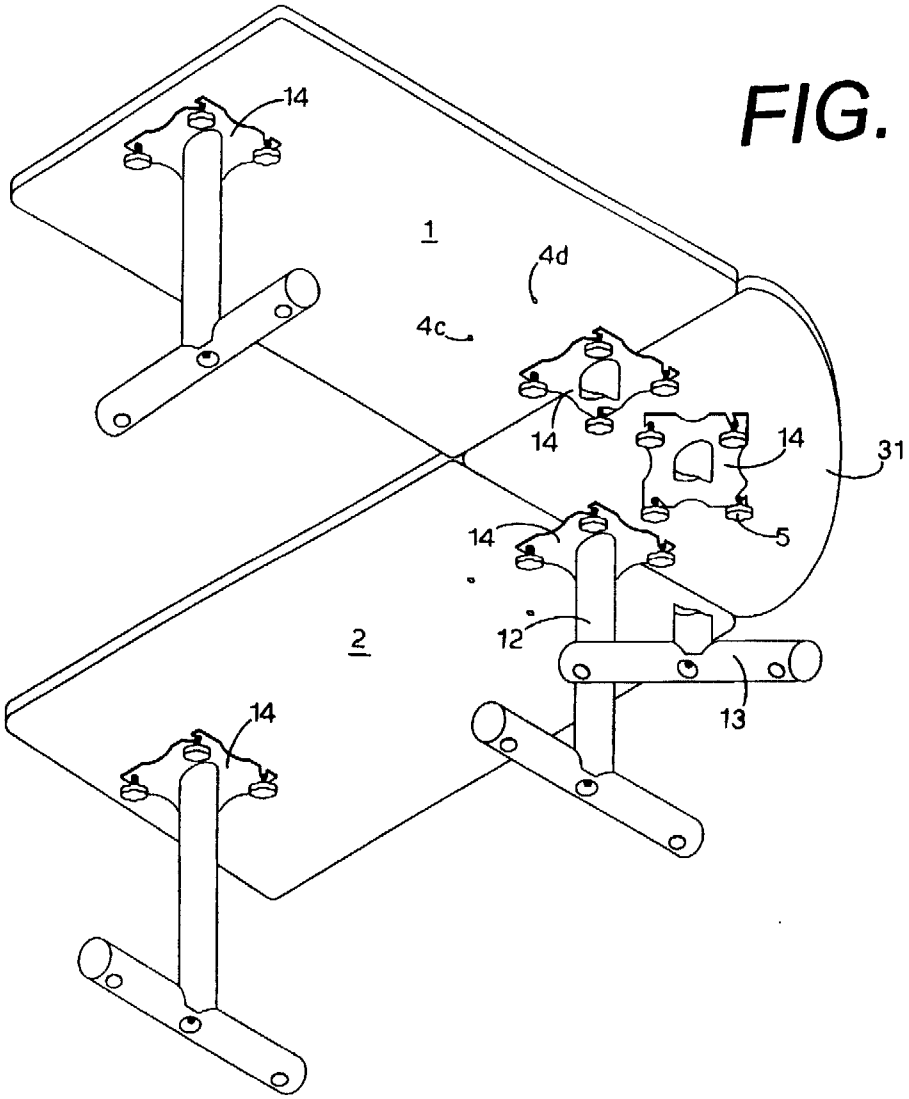
FIG. 14 is a perspective view of the bottom side of the triangular shaped modular table top being linked to a pair of the rectangularly shaped table tops via straddling leg brackets to form a composite L shaped table, with the triangular shaped table top also including a centered leg bracket.
Figure 15:
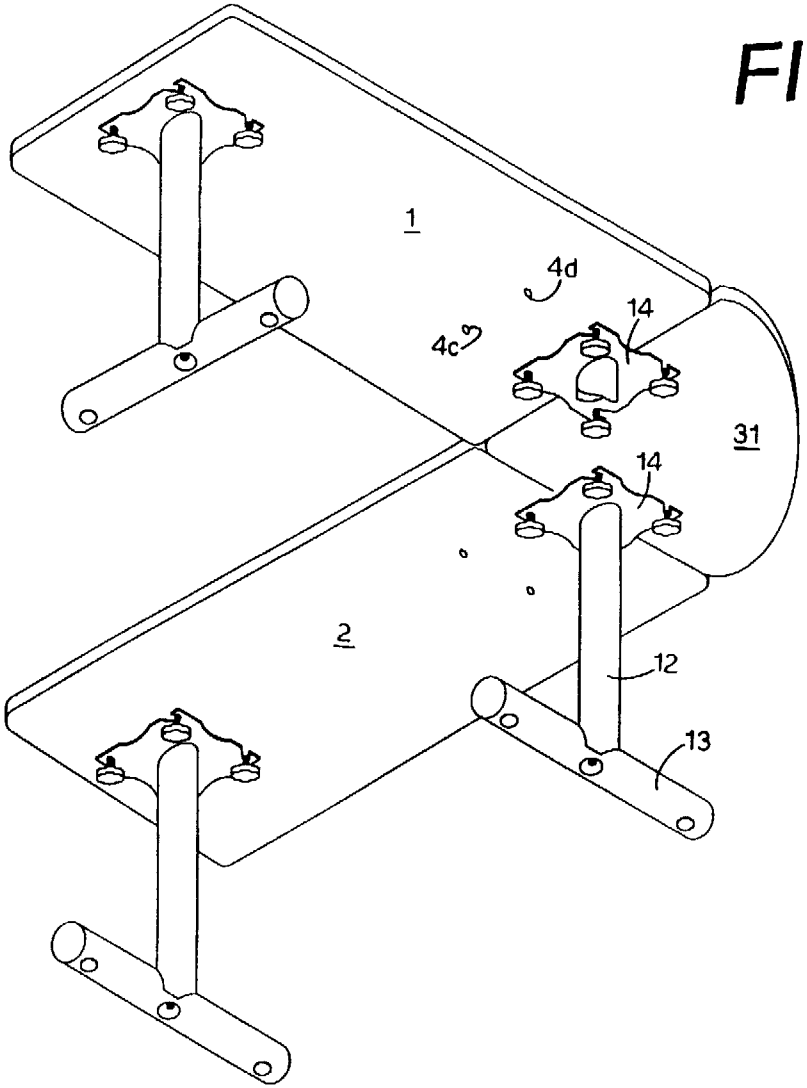
FIG. 15 is a perspective view of the bottom side of the triangular shaped modular table top being linked to a pair of the rectangularly shaped table tops via straddling leg brackets to form a composite L shaped table, as in FIG. 14, but with the centered leg bracket removed from the triangular shaped table top.

FIGS. 14 and 15 illustrate the linking of the table top 31 to the rectangular table tops 1 and 2 via a pair of leg brackets 14, utilized in the same fashion as described earlier with respect to FIG. 1, i.e. each linking leg bracket 14 straddles and links one of the rectangular table tops 1 and 2 and the triangular shaped table top 31. FIG. 14 illustrates a third leg bracket 14 for the triangular shaped table top 31 while the third leg bracket 14 has been eliminated in FIG. 15.

Figure 16:
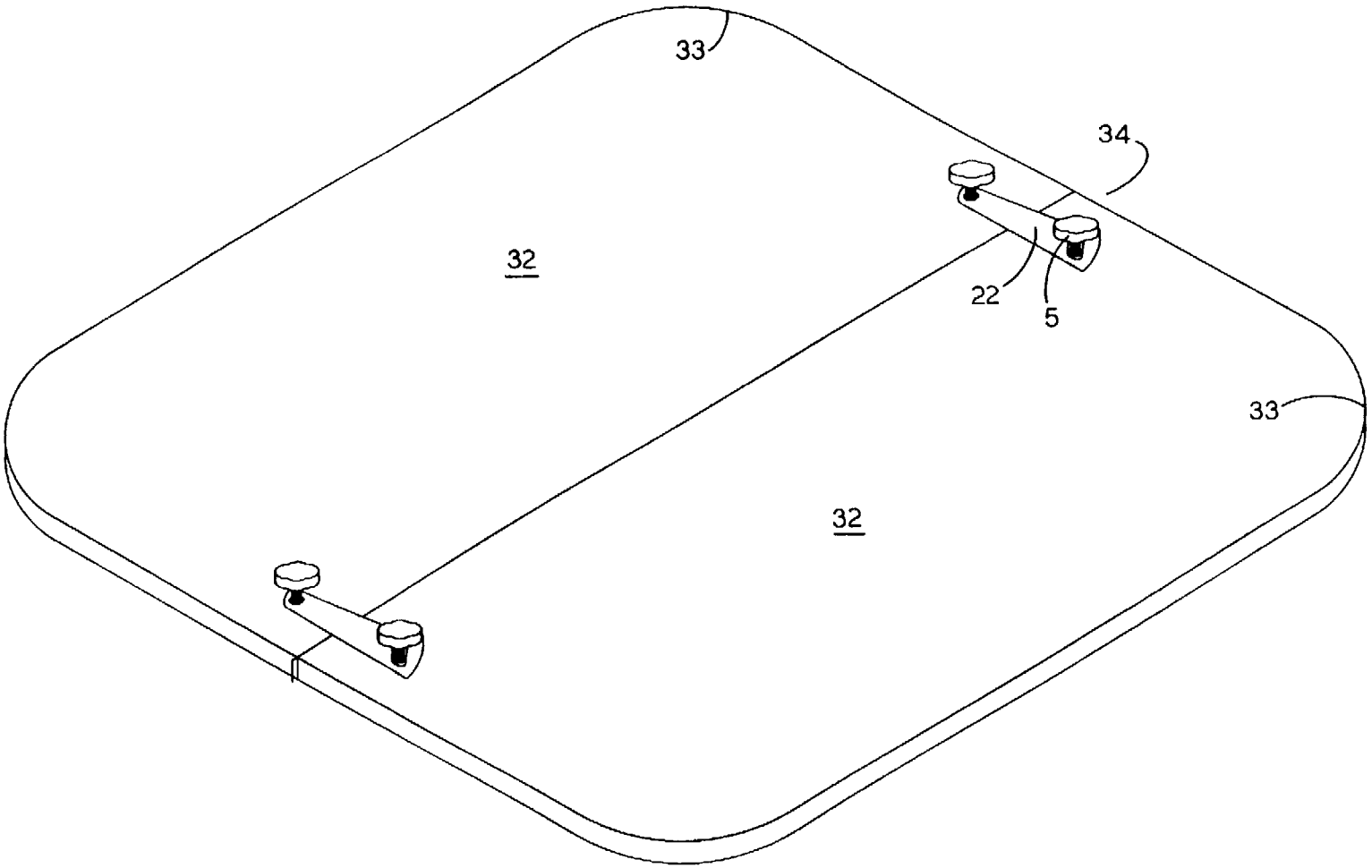
FIG. 16 is a perspective view of the bottom side of a pair of generally rectangular modular table tops with curved corners linked to form a composite square table with curved corner, and with legs removed for simplicity of illustration.
Figure 17:
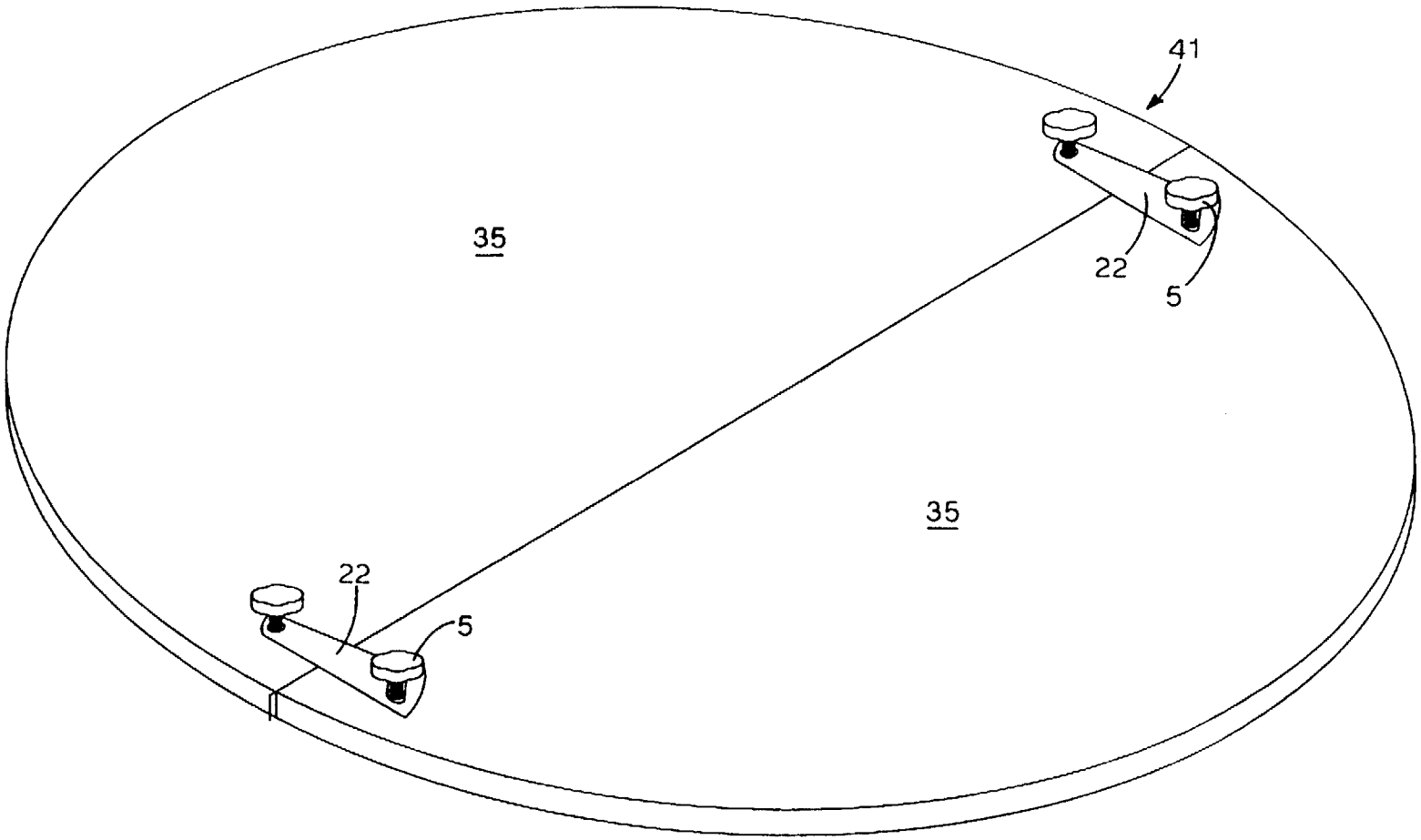
FIG. 17 is a perspective view of the bottom side of a pair of semi-circular modular table tops linked to form a composite round table, again with legs removed for simplicity of illustration.
Figure 18:
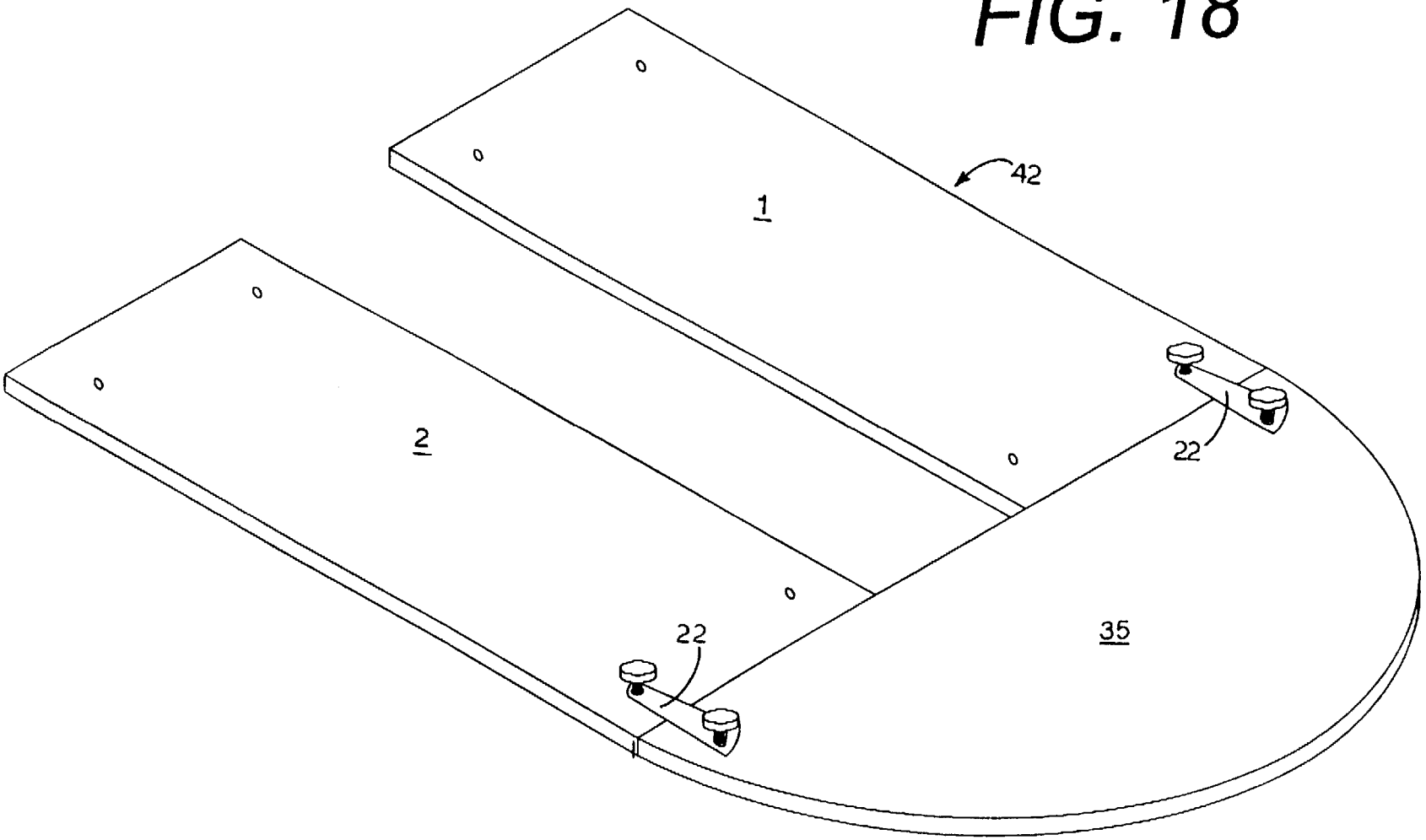
FIG. 18 is a perspective view of the bottom side of a semi-circular modular table top linked to a pair of rectangular modular table tops to form a composite conference table, again with legs removed for simplicity of illustration.

FIGS. 16, 17 and 18 illustrate other combinations of modular table top shapes which can be linked in a fashion similar to that described above. FIG. 16 illustrates a pair of generally rectangular modular table tops 32, each with rounded corners 33, which table tops 32 are linked via linking members 22 to form a generally square table 34 with rounded corners 33. FIG. 17 illustrates a pair of semi-circular modular table tops 35, which table tops 34 are linked via linking members 22 to form a generally round table 41. Finally, FIG. 18 illustrates a single semi-circular modular table top 32 which is linked to a pair of rectangular table tops 1 and 2 via linking members 22 to form a conference table 42. For purposes of ease in illustration, no leg brackets 14 have been shown in FIGS. 16-18, it being understood that it is contemplated that each table top 1, 2, 31 and 32 would include at least one leg bracket 14, or, in the case of the round table 41, at least one straddling leg bracket 14.

In addition to the illustrated table top shapes and linking arrangements, it is contemplated that other shapes and arrangements can be used as well. For example, square, oval, hexagonal, and octagonal shapes, among others, can be used, or created using linked modular table tops of the herein described, or other shapes. Furthermore, the leg brackets 14 can be shaped other than as squares, for example, as rectangles or circular plates, and can be equally useful. The linking members 22 can also vary in shape so long as they incorporate the requisite apertures 23 and slots 24 at either end thereof.

It is thus to be understood that while certain forms of the present invention have been illustrated and described herein, it is not to be limited to the specific forms or arrangement of parts described and shown.

What is claimed and desired to be secured by Letters Patent is as follows:

1. A linkable modular table assembly comprising:

a) a plurality of modular table tops, each said table top including a plurality of threaded anchors positioned in a bottom side thereof;

b) a plurality of fasteners, each with a threaded shaft with a predetermined diameter and a head larger than said predetermined diameter;

c) at least one leg bracket with multiple sides, said leg bracket holding a supporting leg, said leg bracket including a plurality of leg bracket slots arranged in a pattern with each said leg bracket slot sized to receive the shaft of a respective said fastener but not the head of said fastener with each leg bracket slot extending inward from a respective side of said leg bracket; and d) at least some of said threaded anchors on some of said table tops are arranged in patterns which match the pattern of said leg bracket openings such that said leg brackets can be attached beneath individual table tops via a plurality of said fasteners; and wherein e) when a pair of said table tops are positioned adjacent to each other with edges aligned, a combination of said anchors on both said table tops near said aligned edges are also arranged in a pattern which matches said pattern of said leg bracket openings such that said leg brackets can be attached to straddle and link said two tables together and such that said leg bracket can be removed from or installed on said table tops by loosening the fasteners and rotating said leg bracket until said slots disengage, or engage, respectively, respective ones of said fasteners in said pattern.

2. A linkable modular table top system as in claim 1, wherein:

a) said leg bracket comprises a plate with four approximately orthogonal sides.

3. A linkable modular table top system as in claim 2, wherein:

a) the patterns formed by said leg bracket slots, said threaded anchors on a single table top, and said combinations of threaded anchors on an adjacent pair of table tops are square.

4. A linkable modular table top system as in claim 1, and further comprising:

a) at least one linking member comprising an elongate plate with linking member openings near each end, said linking member openings being spaced apart a predetermined distance such that the distance between said linking member openings is equal to a distance between adjacent ones of said leg bracket slots in said pattern.

5. A linkable modular table top system as in claim 4, wherein:

a) a first of said linking member openings is an aperture and a second of said linking member openings is formed as a slot.

6. A linkable modular table assembly comprising:

a) a plurality of modular table tops;

b) a plurality of fasteners, each with a threaded shaft with a predetermined diameter and a head larger than said predetermined diameter;

c) a plurality of leg brackets, each said leg bracket mounting a supporting leg, each leg bracket comprising a plate with four approximately orthogonal sides and including a plurality of linking member slots arranged in a square pattern with each linking member slot positioned in a respective side of said plate and sized to receive the shaft of a respective said fastener but not the head of said fastener; and d) a plurality of threaded anchors positioned in a bottom side of each table top, with each said anchor accommodating a respective one of said threaded shafts; wherein e) at least some of said threaded anchors on some of said table tops are arranged in square patterns which match the pattern of said leg bracket slots such that said leg brackets can be attached beneath individual table tops via a plurality of said fasteners; and wherein f) when a pair of said table tops are positioned adjacent to each other with edges aligned, a combination of said anchors on both said table tops near said aligned edges are also arranged in a square pattern which matches said square pattern of said leg bracket slots such that said leg brackets can be attached to straddle and link said two tables together.

7. A linkable modular table top system as in claim 6, wherein:

a) said leg bracket slots are angled with each leg bracket slot extending inward from a respective side of said bracket such that each sail leg bracket can be removed from or installed on said table tops by loosening the fasteners and rotating said plate until the leg bracket slots disengage, or engage, respectively, the fasteners in said square pattern.

8. A linkable modular table top system as in claim 6, and further comprising:

a) at least one linking member comprising an elongate plate with linking member openings near each end, said linking member openings being spaced apart a predetermined distance such that the distance between said linking member openings is equal to a distance between adjacent ones of said leg bracket slots in said pattern.

9. A linkable modular table top system as in claim 8, wherein:

a) a first of said linking member openings is an aperture and a second of said linking member openings is formed as a slot.

10. A linkable modular table assembly comprising:

a) a plurality of modular table tops;

b) a plurality of fasteners, each with a threaded shaft with a predetermined diameter and a head larger than said predetermined diameter;

c) a plurality of leg brackets, each said leg bracket mounting a supporting leg, each leg bracket comprising a plate with four orthogonal sides and including a plurality of leg bracket slots arranged in a square pattern with each leg bracket slot positioned in a respective side of said plate and sized to receive the shaft of a respective said fastener but not the head of said fastener; and d) a plurality of threaded anchors positioned in a bottom side of each table top, with each said anchor accommodating a respective one of said threaded shafts; wherein e) at least some of said threaded anchors on some of said table tops are arranged in square patterns which match the pattern of said leg bracket slots such that said leg brackets can be attached beneath individual table tops via a plurality of said fasteners; and wherein f) when a pair of said table tops are positioned adjacent to each other with edges aligned, a combination of said anchors on both said table tops near said aligned edges are also arranged in a square pattern which matches said square pattern of said leg bracket slots such that said leg brackets can be attached to straddle and link said two tables together; and g) said leg bracket slots are angled with each said leg bracket slot extending inward from a respective side of said bracket such that each said leg bracket can be removed from or installed on said table tops by loosening the fasteners and rotating said plate until the leg bracket slots disengage, or engage, respectively, the fasteners in said pattern.

11. A linkable modular table top system as in claim 10, and further comprising:

a) at least one linking member comprising an elongate plate with linking member openings near each end, said linking member openings being spaced apart a predetermined distance such that the distance between said linking member openings is equal to a distance between adjacent ones of said leg bracket slots in said pattern.

12. A linkable modular table top system as in claim 11, wherein:

a) a first of said linking member openings is an aperture and a second of said linking member openings is formed as a slot.

* * * * *